US007097003B2

(12) United States Patent
Reynolds et al.

(10) Patent No.: US 7,097,003 B2
(45) Date of Patent: Aug. 29, 2006

(54) ELEVATOR LANDING DOOR BROKEN CHAIN SAFETY DEVICE

(75) Inventors: Steven P. Reynolds, Toronto (CA); Richard W. Lajeunesse, Brampton (CA); Zygmunt Dziwak, Mississauga (CA); David E. Kairis, Brampton (CA)

(73) Assignee: The Peelle Company Ltd., Brampton (CA)

( * ) Notice: Subject to any disclaimer, the term of this patent is extended or adjusted under 35 U.S.C. 154(b) by 395 days.

(21) Appl. No.: 10/623,920

(22) Filed: Jul. 21, 2003

(65) Prior Publication Data

US 2005/0016797 A1 Jan. 27, 2005

(51) Int. Cl.
*B66B 5/16* (2006.01)

(52) U.S. Cl. ..... 187/351; 187/356; 187/361; 187/372; 187/376; 49/322; 49/123; 188/188; 188/189; 188/343

(58) Field of Classification Search ..... 187/361, 187/372, 376, 318, 325, 356; 188/188, 189, 188/43, 72.7, 343; 49/119, 120, 270; 74/89.2
See application file for complete search history.

(56) References Cited

U.S. PATENT DOCUMENTS

| | | | | | |
|---|---|---|---|---|---|
| 316,577 | A | | 4/1885 | Schnizlein | |
| 859,718 | A | * | 7/1907 | Abbott | 187/372 |
| 1,108,723 | A | * | 8/1914 | Dolph | 187/372 |
| 1,139,595 | A | | 5/1915 | Starr | |
| 1,707,099 | A | * | 3/1929 | Stein et al. | 187/372 |
| 2,300,630 | A | | 11/1942 | Norton et al. | |
| 2,550,839 | A | | 5/1951 | Martin | |
| 2,618,361 | A | * | 11/1952 | Zindt | 187/372 |
| 3,215,231 | A | | 11/1965 | Lodige | |
| 3,447,637 | A | * | 6/1969 | Berkovitz | 187/319 |
| 3,807,091 | A | * | 4/1974 | Peelle et al. | 49/120 |
| 4,176,826 | A | | 12/1979 | Gray et al. | |
| 4,333,549 | A | | 6/1982 | Davis | |
| 4,696,375 | A | * | 9/1987 | Matthews et al. | 187/313 |
| 5,224,570 | A | | 7/1993 | Fromberg | |
| 5,645,142 | A | | 7/1997 | Kraemer et al. | |
| 6,082,506 | A | * | 7/2000 | Huang et al. | 188/189 |
| 6,105,728 | A | | 8/2000 | Combs, Jr. | |
| 6,173,813 | B1 | | 1/2001 | Rebillard et al. | |
| 6,206,366 | B1 | | 3/2001 | Schmid | |
| 2003/0051409 | A1 | * | 3/2003 | Bruns | 49/322 |

FOREIGN PATENT DOCUMENTS

| | | |
|---|---|---|
| DE | 620 566 | 10/1935 |
| EP | 0 773 181 A1 | 5/1997 |

* cited by examiner

*Primary Examiner*—Kathy Matecki
*Assistant Examiner*—Stefan Kruer
(74) *Attorney, Agent, or Firm*—Pearne & Gordon LLP

(57) ABSTRACT

A vertically sliding freight elevator landing door with a safety brake that deploys when a chain suspending the door breaks. The safety brake is adapted for use on both panels that slide up to open or that slide down to open. The brake, which is simple in construction and installation, comprises, principally, a caliber block fixed to the door and a roller cam assembled in the block. A spring biases the roller cam towards a wedge lock position while a cable normally holds the roller cam in an inactive position. The cable and, therefore, the roller cam are released when the associated door suspension chain breaks. The roller cam, operating between a tilted internal surface in the caliper block and a door guide rail quickly frictionally brakes the door on the guard rail.

6 Claims, 5 Drawing Sheets

ELEVATOR LANDING DOOR BROKEN CHAIN SAFETY DEVICE

BACKGROUND OF THE INVENTION

The invention relates to freight elevator landing doors and, in particular, to a device for stopping a vertically operating door in the event its suspension fails.

PRIOR ART

Freight elevator doors are typically arranged to slide vertically to open and close the opening to a hoistway and an elevator car. A common arrangement for such a door comprises a pair of bi-parting panels, an upper panel and a lower panel, that move vertically towards one another to close and vertically away from one another to open. Other vertically sliding door panel arrangements include slide up to open single or double panels, for example, and slide down to open panels. Ordinarily, each door panel is suspended by a chain, cable or other flexible strand-like element adjacent its vertical edges. The suspension chains and related components can fail through undetected wear and/or accidental damage, for example. Where a chain breaks, the door panel has the potential to fall and cause personal injury and/or property damage to objects below the panel as well as to the panel itself. In such a circumstance, it is desirable to provide a safety stop or brake that will automatically deploy upon failure of a chain and prevent the door panel from falling. U.S. Pat. No. 4,696,375 proposes an elevator door check that is activated when a suspension chain breaks. The device shown in this patent involves a wedge block that must be mounted in such a way as to permit movement relative to the door panel. The inertia of the block can slow its reaction time and any resistance on the surfaces constraining its movement can lead to a malfunction. This patent does not disclose an arrangement that can be used with a lower panel of a bi-parting door unit. From the foregoing, it is apparent that there exists a need for a door panel brake responsive to failure of the suspension chain that is reliable, simple to install and adjust and that can be readily utilized on both the upper and lower panels of a bi-parting door.

SUMMARY OF THE INVENTION

The invention provides a safety brake for vertically sliding freight elevator doors that is responsive to the failure of a suspension chain. The brake is readily adapted to conventional door panels and combinations of panels such as found in bi-parting door types, raise to open types, and lower to open types. The brake of the invention comprises a caliper housing or block fixed to the door panel and a roller cam in the caliper that work in conjunction with a door guide rail. The roller cam is released from an inactive position when a chain breaks, thereby enabling it to wedge lock the caliper to the guide rail. The caliper block and roller cam are preferably configured to enable to the roller cam to be retained in the inactive position, against a bias spring by a cable. The cable restraint feature enables the same basic brake caliper and roller cam components to be used on both upper and lower door panels with only limited variation in hardware to accommodate differences in the locations of a suspension chain relative to the associated door panel.

DESCRIPTION OF THE PREFERRED EMBODIMENTS

Figure 1:
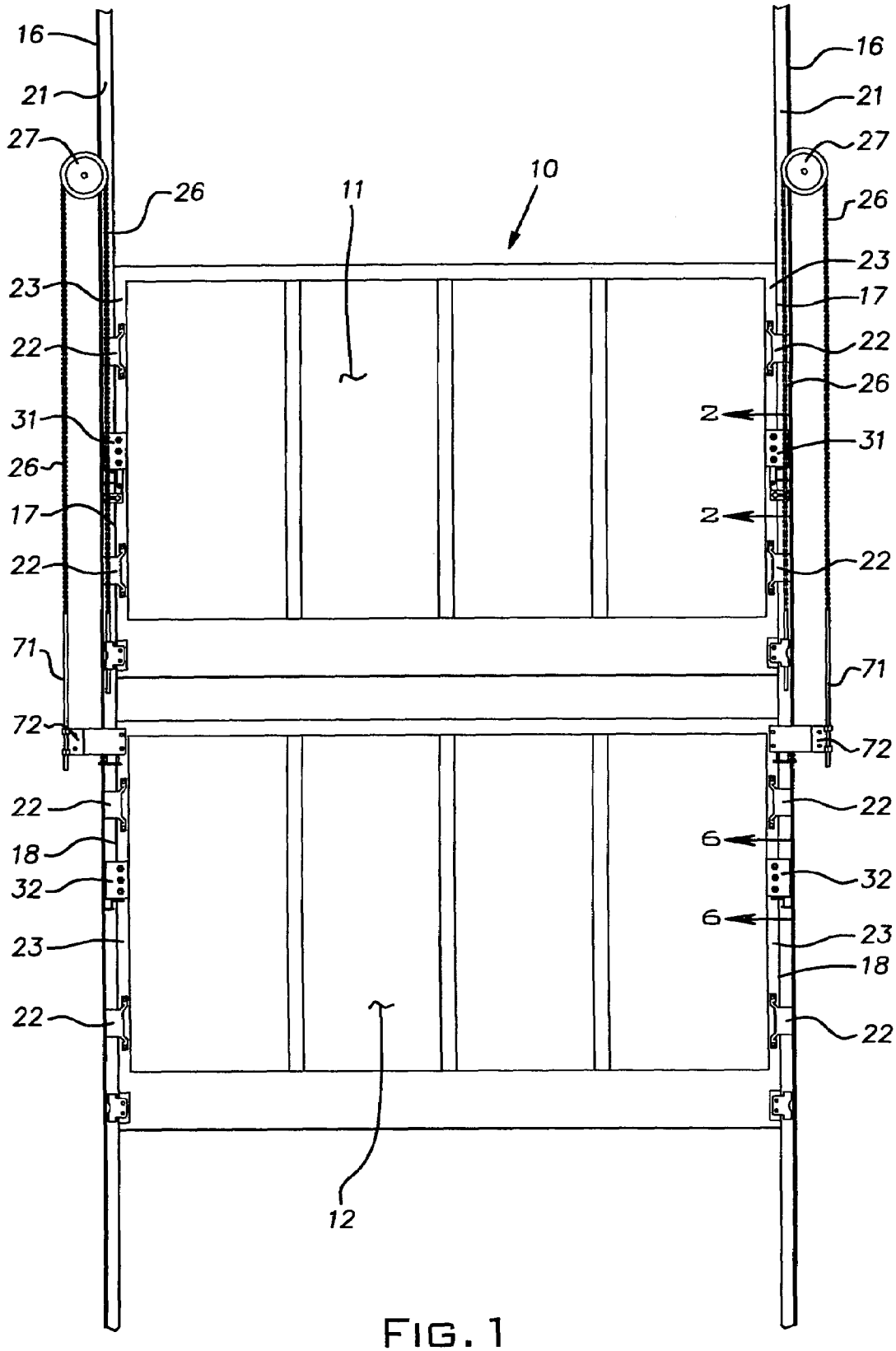
FIG. 1 is an elevational view of a freight elevator landing door having the safety brake device of the invention installed thereon.

Referring now to the drawings and, in particular to FIG. 1, there is shown a freight elevator landing door 10 from the hoistway or shaft side of the door. The illustrated door 10 is a bi-parting type having upper and lower vertically sliding panels 11 and 12. In a conventional manner, the door panels 11, 12, move in opposite directions-toward one another to close and away from one another to open. Typically, the panels 11, 12 are fabricated of sheet steel and structural steel elements such as angles and channels. The panels 11, 12 are guided for vertical movement on parallel vertical guide rails 16, one adjacent each vertical edge 17, 18 of the panels 11, 12, respectively. The guide rails 16 are fixed to the building or other static structure by bolting, welding, or other appropriate technique. The guide rails have a U-shape or J-shaped shape cross-section; one of the flanges of each rail is fixed to the static structure as described and the opposite flange, designated 21 in the figures, serves to guide the respective edges 17, 18 of the panels 11 and 12 for vertical movement. Replaceable guide shoes 22, two pair per panel 11, 12, are bolted to angles 23 at the vertical panel edges 17, 18. The guide shoes 22 are slotted to permit them to receive the guide rail flange 21 of the adjacent guide rail 16. This arrangement, which is generally conventional, assures that the panels 11, 12 to which the guide shoes 22 are fixed, move vertically in alignment along the guide rails 16.

In a conventional manner, the weight of each door panel 11, 12 is used to counterbalance the weight of the other door panel. This is accomplished with roller chains 26 trained over rotatable pulleys 27 fixed in the hoistway at points generally overlying the vertical edges 17, 18 of the door panels 11, 12. Weights can be added to one of the door panels to balance the other, as necessary.

Safety brake devices 31, 32, constructed in accordance with the invention, are mounted on the door panels 11, 12, respectively and, in response to breakage of the chain 26 are effective to stop or check downward free-fall movement of the respective panel. The safety brake devices 31, 32 are symmetrical with one another from one vertical edge 17 to the other 18. FIGS. 2–5 depict a safety device 31 employed on the upper panel 11. The device 31 includes a caliper housing or block 33, a roller cam 34, and an actuating spring 36 of the compression type. The caliper block 33 is preferably made of steel or other suitable high-strength material and can be cast, forged, machined, or otherwise formed into the illustrated configuration. The caliper block 33 can be made of an integral body or can be assembled from two or more parts. The block 31 is bolted to the panel vertical edge angle 23 by bolts assembled through a set of three holes 37 extending through the block. In its installed orientation, the block 33 has a vertical slot 38 that is adapted to receive the flange 21 of the adjacent guide rail 16. The slot 38 is bounded on opposite sides by a vertical surface 39 and a wedging surface 41 tilting from the vertical and converging towards the opposed surface 39 such that it is closer to the vertical surface with increasing elevation or distance upwards along the slot 38. In the illustrated construction, the surfaces 39, 41 are planar and are aligned such that an imaginary horizontal plane passing through these surfaces will intercept each surface at a line which is parallel to the line at the other surface.

Figure 2:
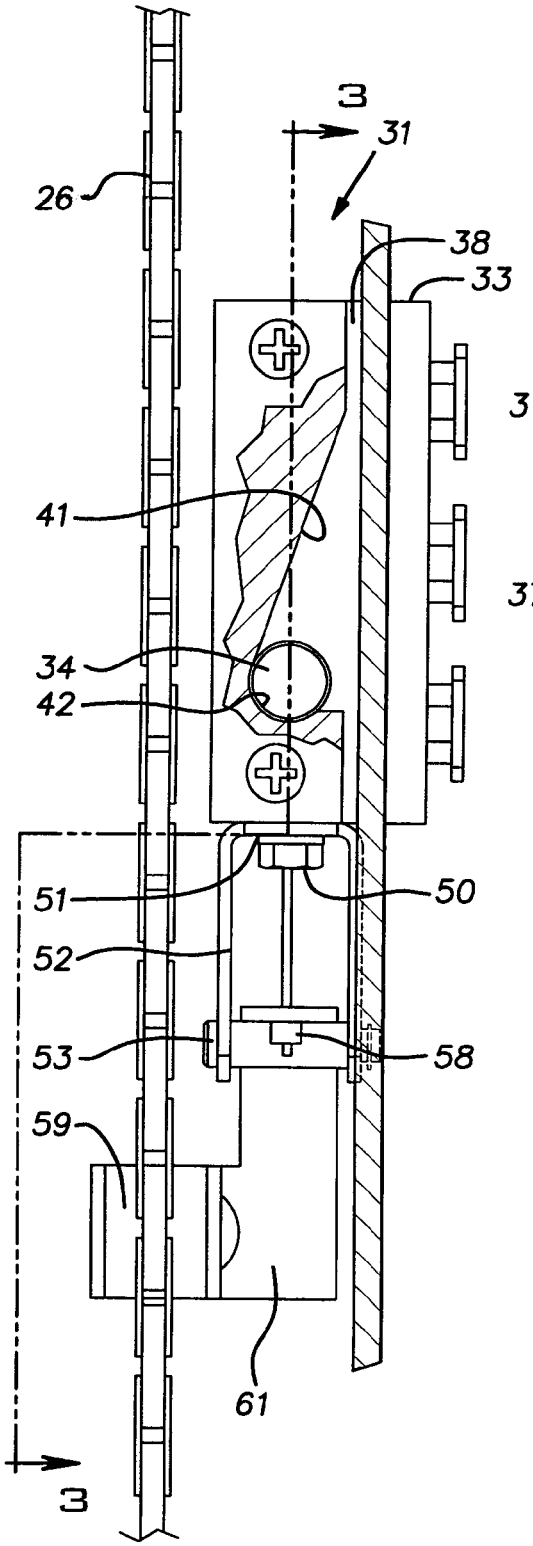
FIG. 2 is a side elevational view of a safety brake device associated with an upper door panel taken along the line 2—2 in FIG. 1 in a normal condition.
Figure 3:
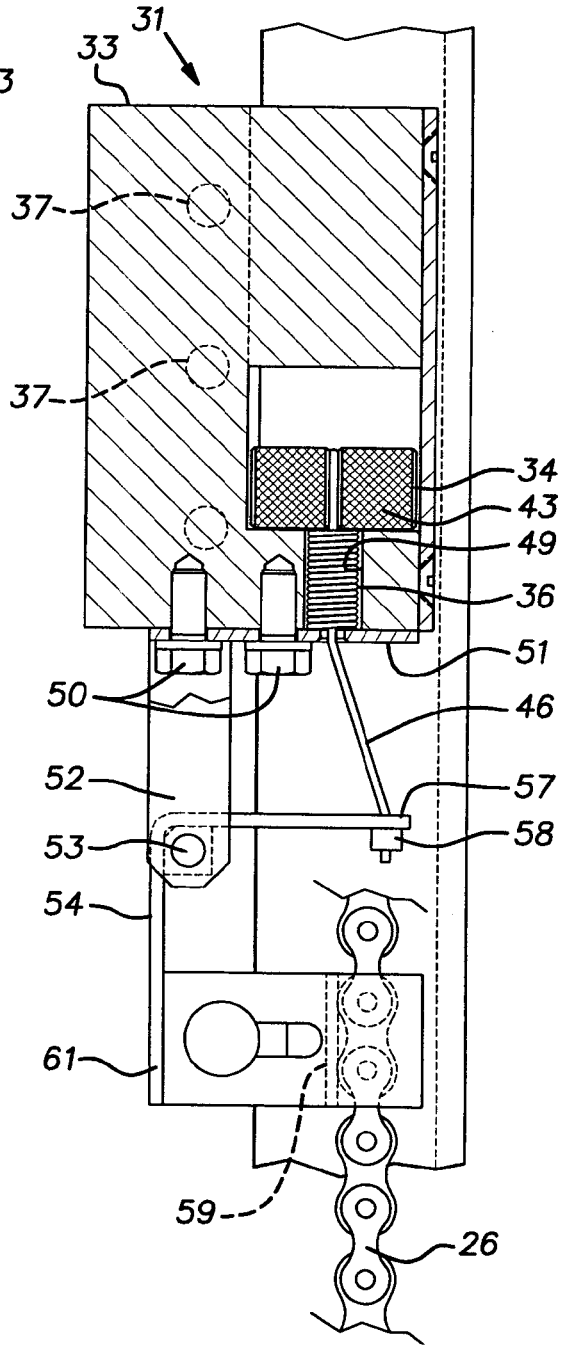
FIG. 3 is a sectional view of the safety brake device of FIG. 2 taken in the staggered plane 3—3 in FIG. 2.
Figure 4:
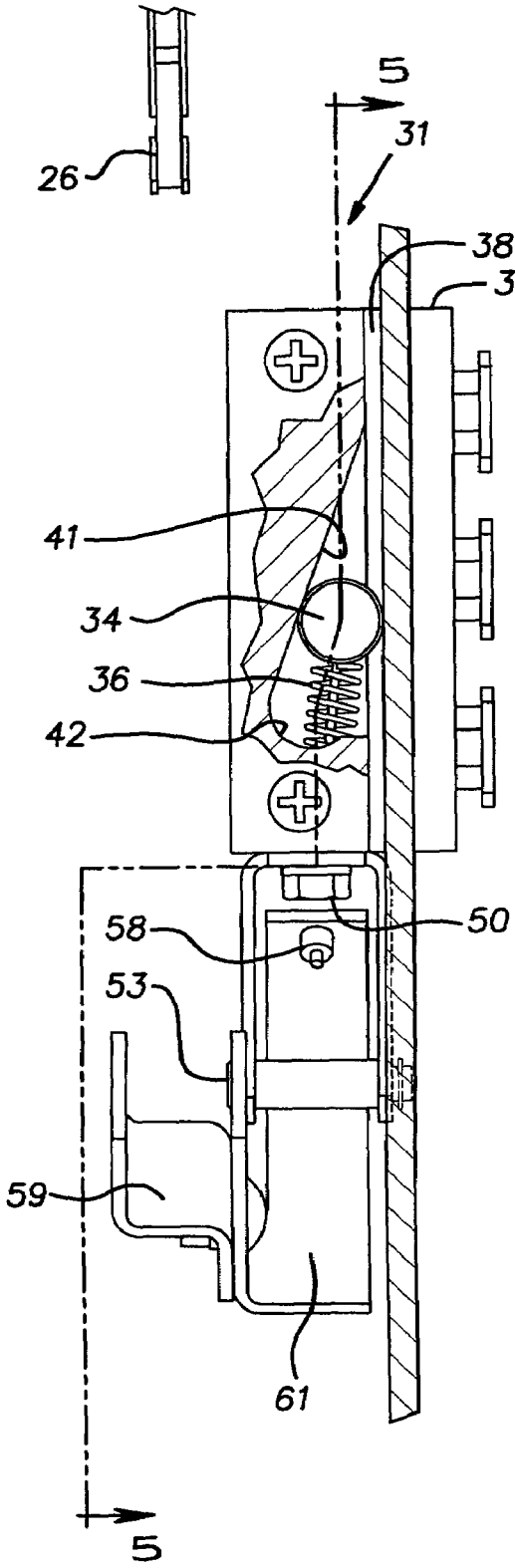
FIG. 4 is a side elevational view similar to FIG. 2, but with an associated section of chain missing to represent breakage thereof and with the device in a door panel braking position.
Figure 5:
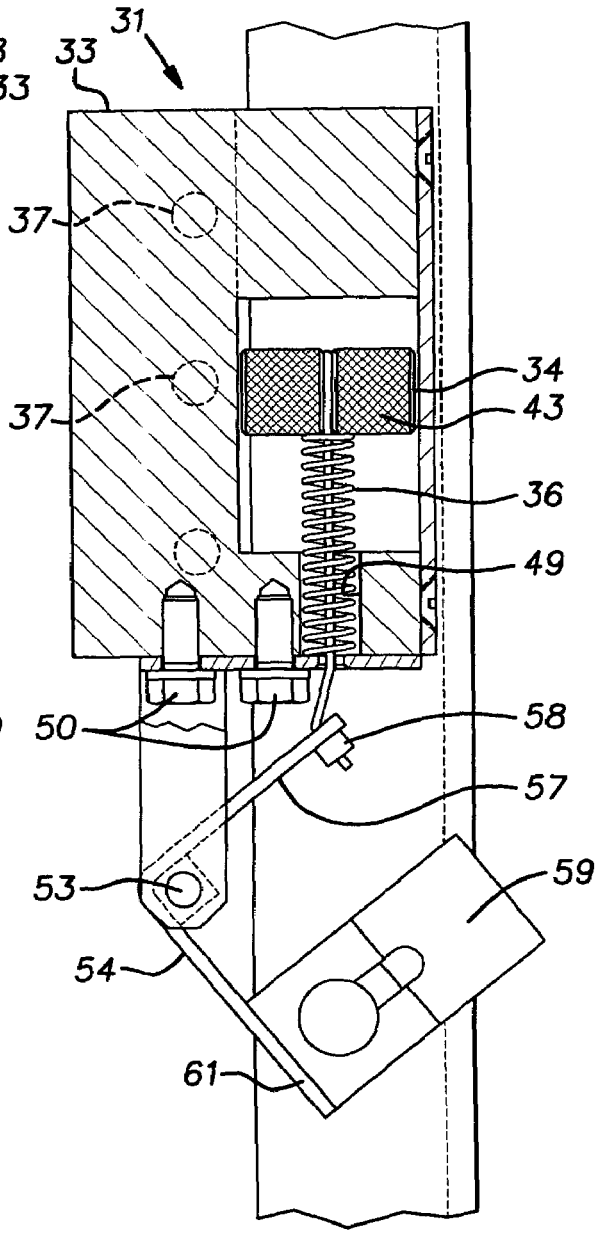
FIG. 5 is a view of the braking device taken in the staggered plane 5—5 in FIG. 4.
Figure 6:
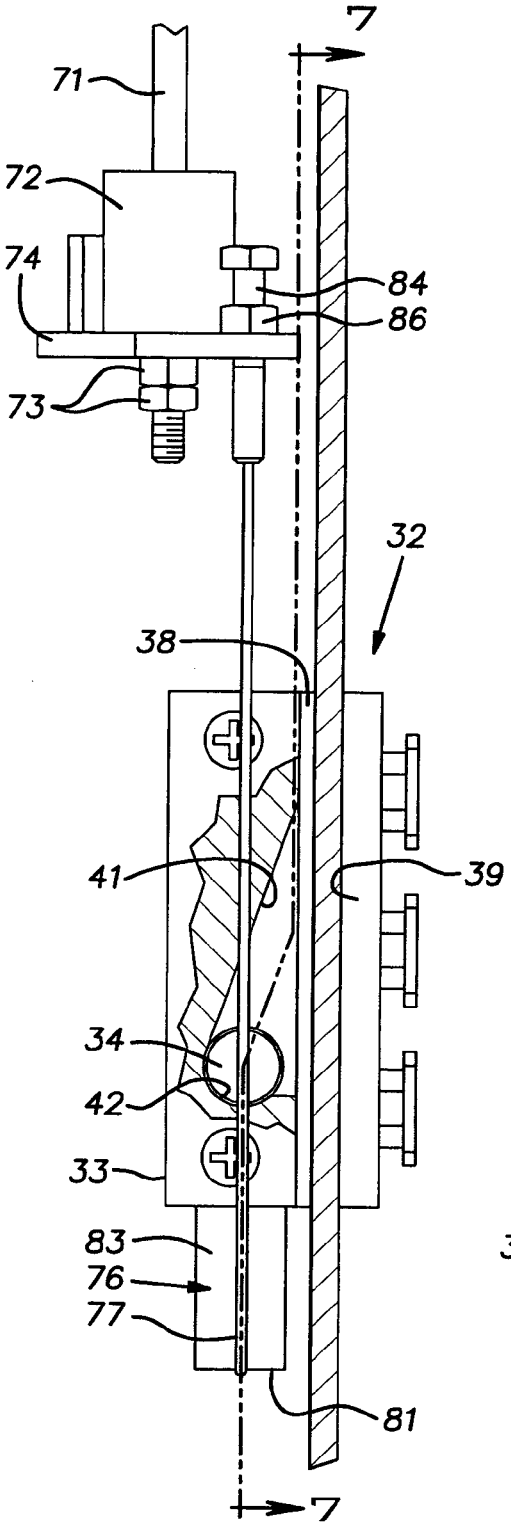
FIG. 6 is a side elevational view of a safety brake device associated with a lower door panel taken in the plane 6—6 in FIG. 1 in a normal condition.
Figure 7:
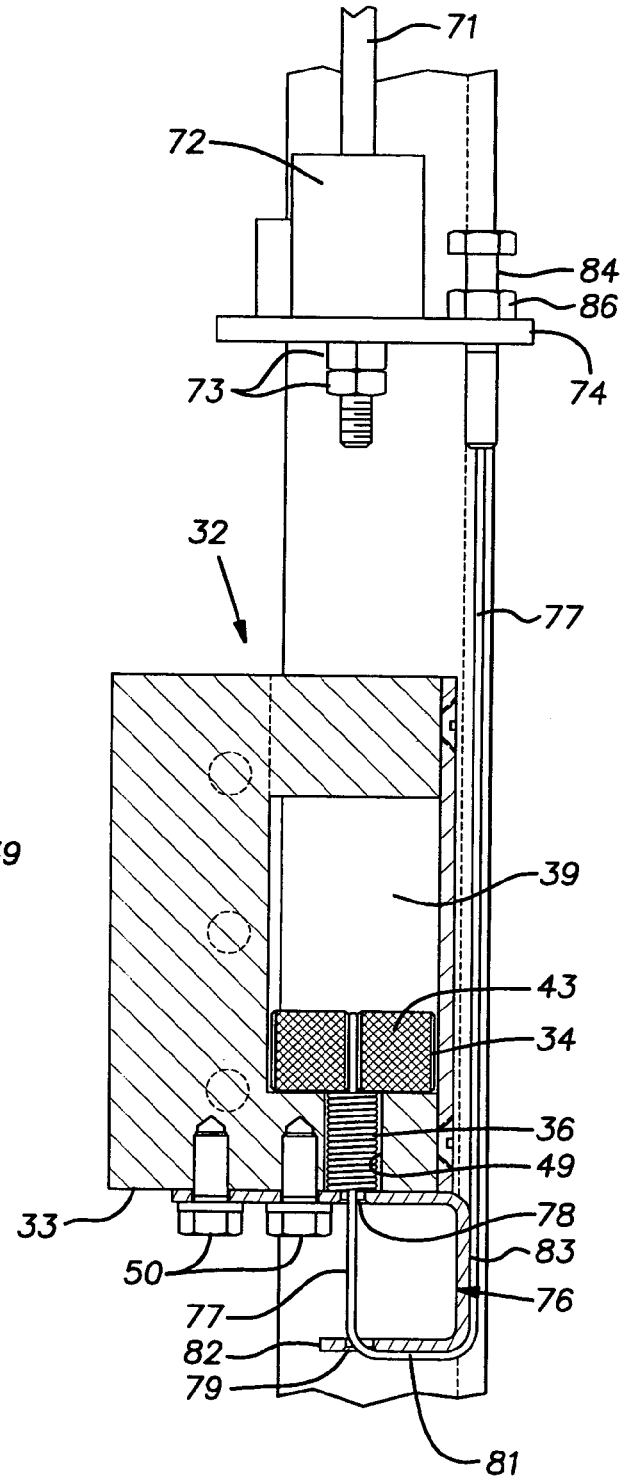
FIG. 7 is a sectional view of the safety brake device of FIG. 6 taken in the staggered plane 7—7 in FIG. 6.
Figure 8:
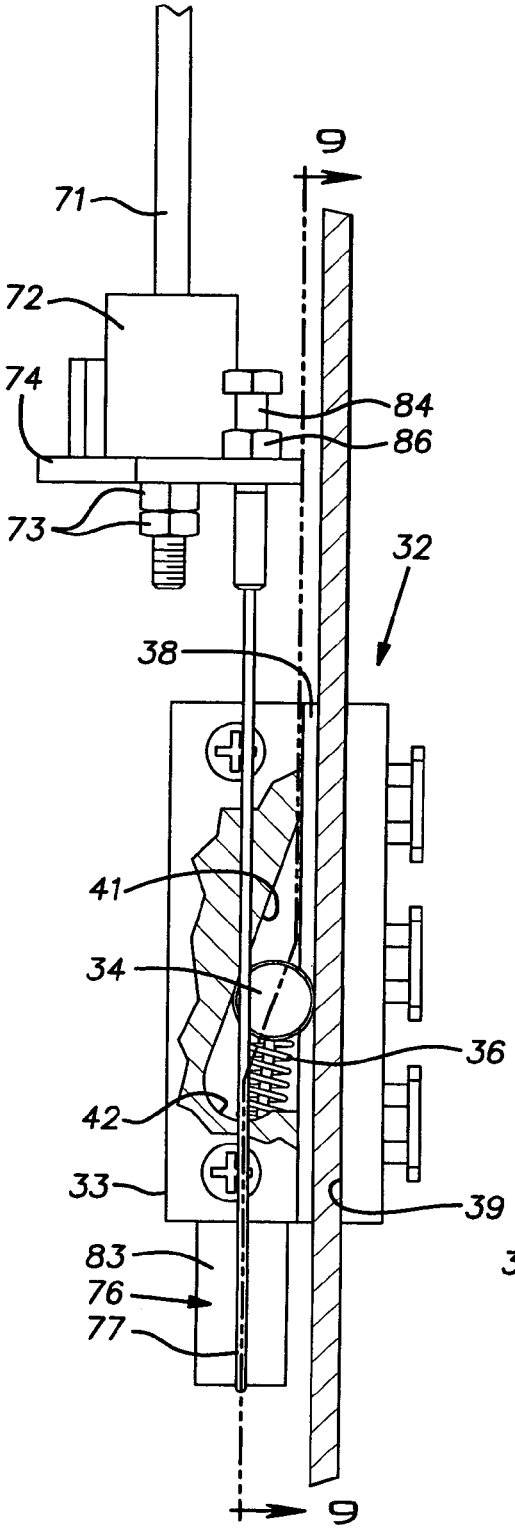
FIG. 8 is a side elevational view similar to FIG. 6, but with an associated section of chain broken and with the device in a door panel braking position.
Figure 9:
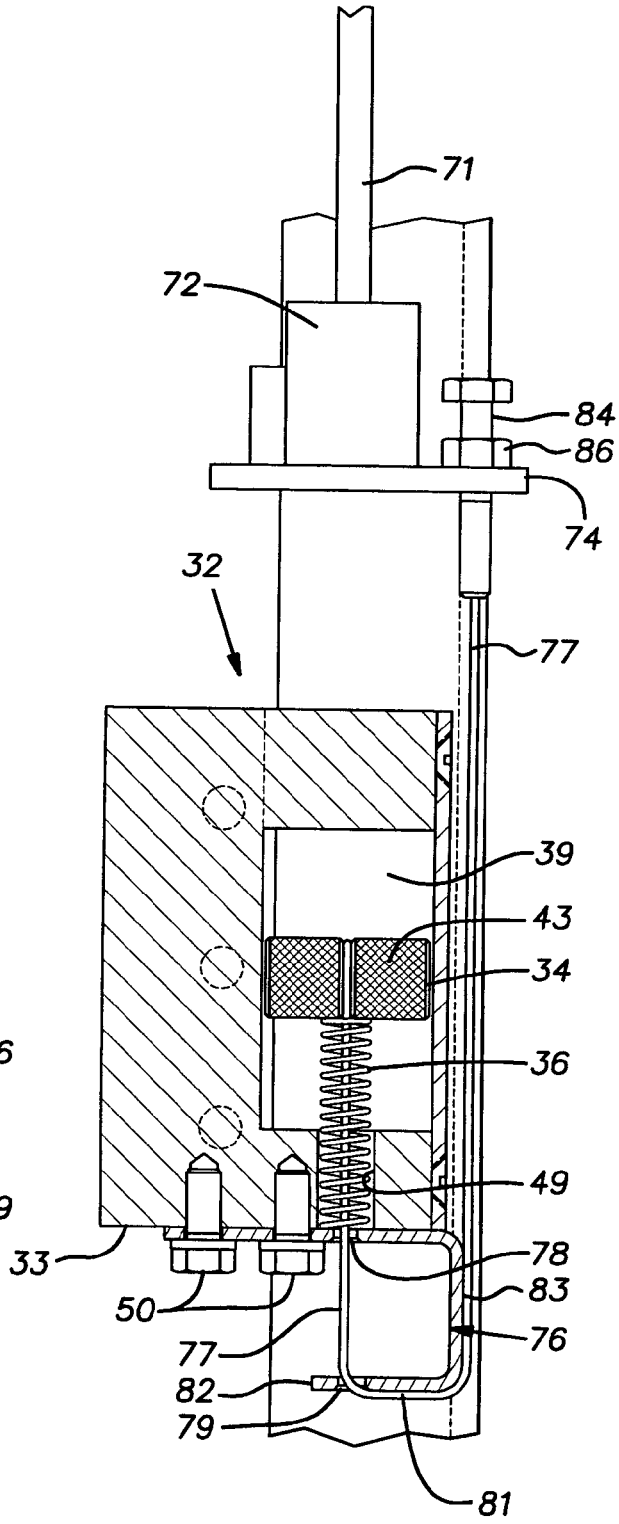
FIG. 9 is a view of the braking device taken in the staggered plane 9—9 in FIG. 8.

A lower end of the wedging surface 41 merges with a more or less semi-cylindrical surface 42 having a radius preferably at least slightly larger than the outer surface 43 of the roller cam 34, which is preferably cylindrical. As shown in FIG. 2, the roller cam 34 is adapted to be received in a cavity bounded by the cylindrical surface 42 and wedging surface 41. When in this cavity, the roller cam 34 does not contact the guide rail flange 21. The roller cam 34 is held or restrained in this cavity in normal conditions by a cable 46 wrapped around it and received in a peripheral groove formed in the outer surface 43 at its mid-section. The groove is of sufficient depth and width to fully receive the diameter of the cable 46 such that the cable is radially inward of the outer cylindrical surface 43. The adjacent end of the cable 46 is crimped onto the cable in a known manner to form a loop into which the roller cam is assembled and which is loose enough to enable the roller cam to rotate in the loop. The compression spring 36 is received in a cylindrical hole 49 drilled or otherwise formed in the caliper block and communicating with the cavity. A bracket 51 fixed on a lower end of the block 33 with bolts 50 retains the compression spring 36 in the hole 49. The bracket 51 has a depending clevis portion 52 that carries a pin 53 on which a bell crank lever 54 pivots. The cable 46 is assembled through the center of the spring 36, a hole in the bracket 51 and has its end remote from the roller cam 34 secured at a hole in an upper arm 57 of the lever 54 by a crimped collar 58.

An extension 59 on a lower arm 61 of the bell crank lever 54 bears against the chain 26 normally carrying the weight of the upper panel 11 as well as the lower panel 12. Tension in the chain 26 allows each panel 11, 12 to balance the weight of the other panel. The chain 26 is attached to the upper panel 11 with a chain rod 71 assembled through and anchored to a bracket 72 bolted to the upper panel 11. Tension in the chain 26, due to the weight of the door panels 11, 12, ordinarily prevents counterclockwise rotation of the bell crank lever 54 (as viewed in FIG. 3). The length of the cable 46 is arranged to control and keep the roller cam 34 in the cylindrical portion of the cavity when the chain 26 maintains the bell crank 54 in the position illustrated in FIGS. 2 and 3. Inspection of FIG. 2 reveals that the caliper housing or block 33, rigidly fixed to the door panel 11, is ordinarily arranged to slide freely along the door guide rail flange 21.

In the event that the chain 26 supporting the door panel 11 breaks or otherwise suffers a loss of tension, the bell crank lever 54 is released. The bell crank 54 is thereby enabled to pivot counter-clockwise under a bias force developed by the compression spring 36 and transmitted by tension in the cable 46. Tension in the cable 46 is released when the bell crank 54 is freed by loss of tension in the chain 26 to pivot counter-clockwise and, in turn, the cable releases the compression spring 36 from the compressed condition of FIGS. 2 and 3. The spring 36 forces the roller cam 34 upwardly out of the cavity or seat area into contact with the guide rail flange 21 and the wedging surface 41. The outer cylindrical surface 43 of the roller cam 34 can be knurled to increase its friction with the guide rail flange 21 and caliper block surface 41. While the roller cam 34 is being raised relative to the caliper block 33 by the spring 36, the associated upper door panel 11 and the caliper block fixed to it have a tendency to begin to free fall. The roller cam 34, as a result of its upward movement in the caliper block 33 and any initial downward movement of the caliper block relative to the guide rail flange 21, is very quickly wedged tightly between the guide rail flange and the wedging surface 41. This action causes the caliper block 33 to be frictionally locked to the guide rail flange 21 and the door panel 11 is thereby immediately braked against further downward movement. More specifically, because of the wedging action by the wedging surface 41 against the roller cam, the vertical surface 39 forming one side of the slot 38 is tightly frictionally locked against the guide rail flange 21. From the foregoing discussion, it will be evident that the caliper block 33 is frictionally locked to the guide rail 16 and the door panel 11 is thereby braked against further downward movement.

The lower door panel 12 at each vertical edge 18 is suspended by a length of the chain 26 secured to a chain rod 71. The chain rod 71 is assembled with a slip fit through bores in a bracket 72 fixed to the lower door panel. Jam nuts 73 threaded on a lower end of the chain rod 71 adjustably locate the chain rod relative to the door panel 12. Assembled on the rod 71 above the nuts 73 is a tension plate 74. From this description, it will be understood that the chain rod 71 and, of course, the chain 26, bears the weight of the lower door panel 12 at the respective end or vertical edge 18 of the panel. The safety brake device or assembly 32, like the device or assembly 31 described above in connection with the upper panel 11 is fixed to each vertical edge or end 18 of the panel 12. Like the safety brake devices 31 associated with the upper panel, the lower panel safety brake devices 32 are symmetrical from one vertical edge 18 to the other. The safety brake device 32 mounted on the right vertical edge 18 of the lower panel 12 in FIG. 1 is shown in greater detail in FIGS. 6–9. The brake device or assembly 32 includes a caliper block 33, roller cam 34, and compression spring 36 that can, as shown, be identical to that described in FIGS. 2–5 for the upper panel 11. As with the upper door panel, the caliper block 33 is rigidly fixed to the vertical structural angle 23 with three bolts assembled through holes 37 in the block and the slot 38 is arranged to receive and normally slide along the vertical guide rail flange 21.

A J-shaped bracket 76 is secured to the bottom of the caliper block 33 with bolts 50. The bracket 76 has a pair of holes in vertical alignment with the axis of the spring receiving bore or hole 49. A cable 77 having one end looped around and locked into the peripheral groove in the roller cam 34 is threaded through the bracket holes 78, 79. The cable 77 is routed over a lower face 81 of a flange 82 of the bracket 76 and vertically over an outer face of a web 83 of the bracket. An end of the cable 77 remote from the roller cam 34 is anchored in a threaded bolt 84. The bolt 84 is received in a hole or slot in the tension plate 74 associated with the chain rod 71. A threaded nut 86 on the bolt 84 permits the bolt to be axially adjusted in the vertical direction in the plate 74 so that when the various parts are assembled, the cable 77 can be properly tensioned to control and hold the roller cam 34 in the recess or cavity and out of contact with the guide rail flange 21.

In the event that the suspension chain 26 breaks or some other mishap occurs where the chain supporting the weight of the respective end of the lower panel 12 loses tension, the chain rod 71 is enabled to drop in the bracket 72 and move downwards relative to the door panel 12. Relative motion between the chain rod 71 and tension plate 74 releases tension on the cable 77 so as to allow the compression spring 36 to extend and force the roller cam into a wedging action between the wedging surface 41 and guide rail flange 21. In a manner like that described in connection with the upper panel 11 and the associated safety brake device 31, the lower safety brake device 32 very quickly stops any tendency of the lower panel to free fall by frictionally locking the device relative to the guide rail 16.

It will be seen that the devices 31, 32 share common parts so as to minimize cost and inventory. The control of the roller cam 34 through simple cables 46 and 77 enables the devices 31, 32 to be constructed without close dimensional tolerances and with minimal inertia so as to assure a quick response in release of the roller cam 34. It will be understood that the safety brake devices 31, 32 at each end or vertical edge of a panel are symmetrical with the devices on the opposite panel end.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A freight elevator landing door assembly comprising a generally rectangular panel that slides vertically for opening and closing movement, a pair of spaced guide rails adapted to be fixed in parallel alignment to the hoistway walls adjacent opposite vertical sides of an opening served by the door panel, the guide rails each having longitudinally extending vertical faces, the door panel having spaced vertical edges adjacent the guide rails and guide elements adjacent said vertical edges for engaging the guide rails so that the door is guided for movement in a vertical plane by said guide rails, a safety brake fixed on the door panel adjacent each of its vertical edges, the safety brake including a caliper block that extends over opposed vertical faces of the adjacent guide rail and is adapted to be fixed relative to the door, a separate chain for suspending the weight of the door panel adjacent each vertical edge, a wedging element moveable vertically in the caliper block between an inactive position and an active position where it frictionally locks the caliper block and, therefore, the door panel to the guide rail, a biasing spring urging the wedging element to move from the inactive position to the active position, and a control element normally holding the wedge element in an inactive position, the control element being responsive to loss of tension in the chain to release the wedging element and allow it to move to the active position under the influence of the biasing spring.

2. A freight elevator landing door assembly as set forth in claim 1, wherein the wedging element is a roller cam.

3. A freight elevator landing door assembly as set forth in claim 1, wherein the control element is a tensioned cable connected to the wedging element and arranged to be released when an associated suspension cable breaks.

4. A freight elevator landing door assembly as set forth in claim 3, wherein the cable is tensioned by a resistance force in the associated suspension chain.

5. A freight elevator landing door assembly as set forth in claim 4, including a body that bears laterally against the suspension chain to develop said resistance force.

6. A safety brake device for a vertically sliding elevator door comprising a caliper block having a slot for receiving a door guide rail and being adapted to be fixed vertically relative to the door, the slot having opposed surfaces with one of the surfaces being tilted towards the other with reference to an upward direction, a roller cam receivable in the slot adjacent the tilted surface, a spring arranged to bias the roller cam upwardly in the slot, a control element normally restraining the roller cam against the bias of the spring to a lower portion of the slot where there is sufficient clearance to receive both the roller cam and a guide rail flange without interference, the control element being arranged to release the roller cam in the event of a failure of an associated chain suspending the door whereby the spring is effective to move the roller cam towards a location in the slot where it wedges tightly against the guide rail flange and prevents relative downward vertical movement between the block and guide rail flange.

* * * * *